United States Patent [19]

Fu

[11] Patent Number: 4,643,919

[45] Date of Patent: Feb. 17, 1987

[54] TEXTILE TREATING COMPOSITIONS AND METHODS

[75] Inventor: Yi-Chang Fu, Cincinnati, Ohio

[73] Assignee: The Procter & Gamble Company, Cincinnati, Ohio

[21] Appl. No.: 827,131

[22] Filed: Feb. 6, 1986

[51] Int. Cl.[4] ..... B05D 3/02; D06M 13/26; D06M 13/34

[52] U.S. Cl. ..... 427/393.1; 252/8.7; 252/8.75; 252/8.8; 252/8.9; 427/389.9

[58] Field of Search ..... 427/389.9, 393.2, 393.1; 252/8.8, 8.9, 8.7, 8.75, 90, 174.12

[56] References Cited

U.S. PATENT DOCUMENTS

| | | | |
|---|---|---|---|
| 2,372,985 | 4/1945 | Roth | 252/8.8 |
| 2,622,045 | 12/1952 | Ester | 427/389.9 X |
| 3,181,961 | 5/1965 | Katzbeck et al. | 106/213 |
| 4,233,164 | 11/1980 | Davis | 252/8.8 |
| 4,276,046 | 6/1981 | Hendricks et al. | 8/532 |
| 4,308,151 | 12/1981 | Cambre | 252/8.8 |
| 4,493,773 | 1/1985 | Cook et al. | 252/8.8 |
| 4,511,495 | 4/1985 | Melville | 252/8.8 X |
| 4,526,694 | 7/1985 | Puchta et al. | 252/8.8 |
| 4,536,316 | 8/1985 | Ramachandran | 252/174.11 |

FOREIGN PATENT DOCUMENTS

| | | |
|---|---|---|
| 585724 | 10/1933 | Fed. Rep. of Germany . |
| 649483 | 8/1937 | Fed. Rep. of Germany . |
| 2475053 | 8/1981 | France . |
| 54/43111 | 12/1979 | Japan . |
| 56/306 | 1/1981 | Japan . |
| 2068429 | 8/1981 | United Kingdom . |

OTHER PUBLICATIONS

*Kirk-Othmer Encyclopedia of Chemical Technology,* Third Edition, vol. 14, pp. 250-269 (Grayson et al. Editors; Wiley-Interscience, New York, NY; 1981).

Sietz, Seifen, Oele, Fette, Wachse; vol. 108 (20), pp. 637-639 (1982).

*Primary Examiner*—Thurman K. Page

*Attorney, Agent, or Firm*—Kim W. Zerby; George W. Allen; Steven J. Goldstein

[57] ABSTRACT

The present invention relates to textile treating compositions which are especially useful for treating textiles in the rinse cycle of a textile laundering operation to provide improved fabric softening and conditioning benefits. The textile treatment compositions comprise a substantially water-insoluble cationic fabric softening agent in combination with a substantially saturated lipid component containing one or more phosphoglycerides. The present invention further relates to a method for softening and conditioning textiles by treating the textiles, preferably during the rinse cycle of a textile laundering operation, with a combination of the softening agent and substantially saturated lipid component.

20 Claims, No Drawings

TEXTILE TREATING COMPOSITIONS AND METHODS

BACKGROUND OF THE INVENTION

The present invention relates to textile treating compositions. In particular, the invention relates to concentrated textile treating compositions which provide improved fabric softening and conditioning benefits, especially when used in the rinse cycle of a textile laundering operation.

Textile treating compositions suitable for providing fabric softening and static control benefits during laundering are wellknown in the art, and have found wide-scale commercial application. Conventionally, rinse-added fabric softening compositions contain, as the active softening component, substantially water-insoluble cationic materials having two long alkyl chains. Typical of such materials are ditallow dimethyl ammonium chloride and imidazolinium compounds substituted with two tallow groups.

Other types of materials are also known as fabric treating and conditioning agents. One such type of fabric conditioning agent is lecithin. Thus, for example, *Kirk-Othmer Encyclopedia of Chemical Technology, Third Edition,* Vol. 14, pages 250–269 (Grayson et al Editors; Wiley-Interscience, New York, N.Y.; 1981), generally discloses the use of lecithin for emulsifying, wetting, softening and conditioning textiles, specifically in the industrial sizing and finishing of textiles. Furthermore, U.S. Pat. No. 2,622,045, to Ester, issued Dec. 16, 1952, discloses compositions useful for lubricating and conditioning textile yarns, particularly cellulose derivatives, during industrial processing of these yarns. Some examples in this patent disclose "lecithin" as a component of yarn-treating compositions.

Textile treating compositions comprising quaternary ammonium salts in combination with other agents to provide additional softening and/or storage stability and/or static control are also known in the art. For example, U.S. Pat. No. 2,372,985, to Roth, issued Apr. 3, 1945, discloses compositions containing a "cation-active material" and a phosphatide. The cation-active materials preferred and specifically disclosed are water-soluble amine salts. Specifically disclosed as the phosphatide component is egg-yolk lecithin and soybean lecithin, both which have unsaturated fatty acid chains. This patent discloses that these compositions have utility during industrial processing as softening agents for wool and other textile fabrics. Furthermore, U.S. Pat. No. 4,308,151, to Cambre, issued Dec. 29, 1981, discloses detergent compositions which have fabric softening and anti-static properties. Disclosed in this patent is the use of soya-derived hydrogenated triglycerides as dispersion inhibitors in detergent compositions which also contain softening agents.

Notwithstanding the foregoing prior art developments, there remains a continuing need to identify additional textile treating compositions of these same types which are especially effective for delivering fabric softening and conditioning benefits to textiles treated therewith. It is accordingly an object of the present invention to provide improved textile treating compositions containing both conventional fabric softening agents and particular types of phospholipid materials. It is a further object of the present invention to provide an improved textile treating method which employs such compositions to impart fabric softening and conditioning benefits.

SUMMARY OF THE INVENTION

The present invention relates to textile treating compositions which provide improved textile softening and conditioning benefits. Such compositions comprise from about 0.1% to about 99.9% by weight of a substantially water-insoluble cationic fabric softening agent and from about 0.1% to about 99.9% by weight of a substantially saturated, phosphoglyceride-containing lipid component. This substantially saturated lipid component comprises at least about 50% by weight of an acetone-insoluble lipid material. This acetone-insoluble lipid material itself comprises at least about 50% by weight of one or more acetone-insoluble phosphoglycerides. The weight ratio of the acetone-insoluble lipid material in the lipid component to the fabric softening agent component is in the range of from about 0.01:1 to about 5:1.

The present invention further relates to a method for treating textiles to impart fabric softening or conditioning benefits to textiles so treated. This method comprises contacting the textiles with a textile softening amount of a combination of a substantially water-insoluble cationic fabric softening agent and a substantially saturated, phosphoglyceride-containing lipid component. The lipid component comprises at least 50% by weight of acetone-insoluble lipid material, and the acetone-insoluble lipid material itself comprises at least about 50% by weight of one or more acetone-insoluble phosphoglycerides. The weight ratio of the acetone-insoluble lipid material to fabric softening agent in the combination ranges from about 0.01:1 to about 5:1.

DETAILED DESCRIPTION OF THE INVENTION

Substantially Water-Insoluble Cationic Fabric Softening Agent

One essential component of the textile treating compositions useful in the present invention comprises a substantially water-insoluble, cationic fabric softening agent. Conventional fabric softening agents of this type are those which are known in the art to provide fabric softening and/or static control benefits when used in textile laundering operations, especially, for example, during use in the rinse cycle of laundering with home laundry washing machines. A wide variety of such materials has been disclosed, for example, in such patents as Morton; U.S. Pat. No. 3,686,025; Issued Aug. 22, 1972; Diery et al; U.S. Pat. No. 3,849,435; Issued Nov. 19, 1974; Morton; U.S. Pat. No. 3,843,395; Issued Oct. 22, 1974; and Zaki; U.S. Pat. No. 4,022,938; Issued May 10, 1977; the disclosures of all four patents being incorporated herein by reference.

Nonlimiting, general examples of classes of compounds which have been disclosed to have fabric softening properties are primary, secondary, and tertiary amines, imidazoles, imidazolines, oxazoles, pyrimidines, imidoethers, substituted pyridines, substituted ammonias, substituted ureas, substituted thioureas, substituted guanidines, substituted betaines, the phosphorus analogs of the foregoing types of materials, and the quaternary salts of the foregoing materials. Conventional fabric softening agents from these classes of compounds generally possess a straight or branched, saturated or unsaturated, carbon chain of at least 8 carbon atoms, or an aliphatic-aromatic group of at least 8 carbon atoms. Such compounds will furthermore frequently have an amine nitrogen occurring either in a straight chain as a primary, secondary, tertiary or quaternary nitrogen atom, or in a heterocyclic ring of 5 to 7 atoms as an imino group, tertiary nitrogen, or quaternary nitrogen.

For use in the compositions and methods of the present invention, the amines and amine derivatives are cationic and are substantially water-insoluble. Preferably the cationic amines and amine derivatives are used in the form of substantially water-insoluble salts, and most preferably are used as the tetraalkyl quaternary ammonium salts or alkyl imidazolinium salts. Generally, therefore, the cationic amine and amine derivatives which have only one alkyl chain longer than about 8 carbon atoms are not useful as the substantially water-insoluble cationic fabric softening agenfts in the present invention.

Substantially water-insoluble cationic fabric softening agents include the softener materials which are di-$C_8$–$C_{30}$, preferably di-$C_{12}$–$C_{24}$, alkyl or alkenyl 'onium salts, especially mono- and poly-ammonium salts, and imidazolinium salts. Optionally, the alkyl or alkenyl groups may be substituted or interrupted by functional groups such as —OH, —O—, —CONH—, —COO—, ethyleneoxy, propyleneoxy, phenyl, benzyl, etc. The number of certain optional functional groups (e.g., —OH, —CONH—) present in the cationic fabric softening agent is limited such that the softening agent is substantially water-insoluble.

One preferred type of these cationic softeners includes the substantially water-insoluble, mono-ammonium compounds which are the quaternary ammonium and amine salt compounds having the formula:

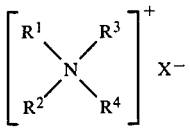

wherein $R^1$ and $R^2$ represent, independently, alkyl or alkenyl groups of from about 8 to about 30, preferably from about 12 to about 24, carbon atoms, and optionally substituted or interrupted by groups such as —OH, —O—, —CONH—, —COO—, ethyleneoxy, propyleneoxy, phenyl, benzyl, etc.; $R^3$ and $R^4$ represent, independently, hydrogen, or alkyl, alkenyl or hydroxyalkyl groups containing from 1 to about 4 carbon atoms, and optionally substituted or interrupted by groups such as —O—, —CONH—, —COO—, ethyleneoxy, propyleneoxy, etc.; and X is the salt counteranion, preferably selected from halide, methylsulfate, ethylsulfate, and organic anions. The number of certain optional functional groups (e.g., —OH, —CONH—) present in the cationic fabric softening agent is limited such that the softening agent is substantially water-insoluble.

Representative examples of these quaternary softeners include: ditallow dimethyl ammonium chloride; ditallow dimethyl ammonium methyl sulfate; dihexadecyl dimethyl ammonium chloride; di(hydrogenated tallow alkyl) dimethyl ammonium chloride; dioctadecyl dimethyl ammonium chloride; dieicosyl dimethyl ammonium chloride; didocosyl dimethyl ammonium chloride; di(hydrogenated tallow) dimethyl ammonium methyl ssulfate; dihexadecyl diethyl ammonium chloride; di(coconut alkyl) dimethyl ammonium chloride; di(coconut alkyl) dimethyl ammonium methylsulfate; di(tallowyl amido ethyl) dimethyl ammonium chloride; di(tallowyl amido ethyl) dimethyl ammonium methylsulfate; di(tallowyl amido propyl) dimethyl ammonium chloride; and di(tallowyl amido propyl) dimethyl ammonium methylsulfate.

Another preferred type of substantially water-insoluble cationic fabric softening agent includes compounds from the class of tri-$C_8$–$C_{30}$, preferably tri-$C_{12}$–$C_{24}$, quaternary ammonium salts. These compounds have structures similar to the di-$C_8$–$C_{30}$ alkyl or alkenyl quaternary ammonium salts immediately hereinbefore described, except that either the $R^3$ or $R^4$ group is a $C_8$–$C_{30}$, preferably a $C_{12}$–$C_{24}$, group selected from the same groups as can be used for the $R^1$ and $R^2$ groups. Representative examples are tri(hardened tallowalkyl)-methylammonium salts, trioleylmethylammonium salts, and tripalmitylmethylammonium salts.

Yet another preferred type of conventional cationic fabric softening agent includes the substantially water-insoluble materials which are the alkyl imidazolinium salts and alkyl pyrimidinium salts believed to have the formula:

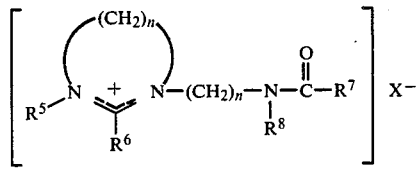

wherein the n's are, independently, an integer from about 2 to about 6, preferably n=2 or 3; $R^5$ is hydrogen or an alkyl, alkenyl or hydroxyalkyl group containing from 1 to about 4, preferably 1 or 2, carbon atoms, optionally substituted or interrupted by groups such as —O—, —CONH—, —COO—, ethyleneoxy, propyleneoxy, etc.; $R^6$ and $R^7$ are, independently, alkyl or alkenyl groups containing from about 8 to about 30, preferably from about 12 to about 24, carbon atoms, optionally substituted or interrupted by groups such as —OH, —O—, —CONH—, —COO—, ethyleneoxy, propyleneoxy, phenyl, benzyl, etc.; $R^8$ is hydrogen or an alkyl, alkenyl or hydroxyalkyl group containing from 1 to about 4 carbon atoms, optionally substituted or interrupted by groups such as —O—, —CONH—, —COO—, ethyleneoxy, propyleneoxy, etc.; and X is the salt counteranion, preferably selected from halide, methylsulfate, ethylsulfate, and organic anions. The number of certain optional functional groups (e.g., —OH, —CONH—) present in the cationic fabric softening agent is limited such that the softening agent is substantially water-insoluble.

Representative examples of the fabric softening alkyl imidazolinium salts include: 3-methyl-1-(tallowylamido) ethyl-2-tallowyl-4,5-dihydroimidazolinium methylsulfate; 3-methyl-1-(palmitoylamido)ethyl-2-octadecyl-4,5-dihydroimidazolinium chloride; 2-heptadecyl-3-methyl-1-(2-stearylamido)-ethyl-4,5-dihydroimidazolinium chloride; 2-lauryl-3-hydroxyethyl-1-(oleylamido)ethyl-4,5-dihydro imidazolinium chloride; and protonated 1-hardtallow amido ethyl-2-hardtallow imidazoline. Also suitable as conventional fabric softening agents herein are the imidazolinium fabric softening components of U.S. Pat. No. 4,127,489, incorporated herein by reference.

All of the foregoing types of conventional cationic fabric softening agents can be readily synthesized in known manner. Many of these materials are, in fact, commercially available. Representative commercially available materials of the above classes include the quaternary ammonium compounds Adogen 448E® (trademark of Sherex Chemical Company, Inc., Dublin, Ohio; comprises approximately 85% ditallow dimethyl ammonium chloride) and Varisoft 110® (trademark of Sherex Chemical Company, Inc., Dublin, Ohio; comprises methyl bis(hydr.tallowamidoethyl)2-hydroxyethyl ammonium methyl sulfate); and the imidazolinium compound Varisoft 475® (trademark of Sherex Chemical Company, Inc., Dublin, Ohio; comprises methyl-1-tallow amido ethyl-2-tallow imidazolinium methyl sulfate).

Particularly preferred specific compounds for use as the fabric softening agent in the compositions of the present invention are: ditallow dimethyl ammonium chloride (particularly Adogen 448E®), ditallow dimethyl ammonium methyl sulfate, and methyl-1-tallow amido ethyl-2-tallow imidazolinium methyl sulfate.

The conventional cationic fabric softening agents useful in the present invention are substantially water-insoluble. Such materials are, however, frequently water-dispersible and these can readily be formulated into aqueous textile treating compositions.

The substantially water-insoluble cationic fabric softening agents are utilized in the textile treating compositions herein in an amount of from about 0.1% to about 99.9% by weight, more preferably from about 0.1% to about 30% by weight, most preferably from about 1% to about 10% by weight of the composition. This fabric softening agent is also utilized in a particular weight ratio vis a vis the substantially saturated phosphoglyceride-containing lipid component as hereinafter described in greater detail.

Substantially Saturated Phosphoglyceride-Containing Lipid Component

A second essential component of the textile compositions herein comprises a substantially saturated, phosphoglyceride-containing lipid component. This lipid component will generally be anionic in nature and is thus distinct from the conventional, substantially water-insoluble cationic fabric softening agents hereinbefore described.

The substantially saturated, phosphoglyceride-containing lipid component will generally contain at least about 50%, preferably from about 50% to about 95%, and more preferably from about 55% to about 75%, by weight of lipid materials which are acetone insoluble. This acetone-insoluble lipid material itself comprises at least about 50%, more preferably at least about 60%, by weight of one or more acetone-insoluble phosphoglycerides. More particularly, such phosphoglyceride material will generally be selected from the group consisting of phosphatidyl choline (i.e., "pure lecithin"), phosphatidyl ethanolamine, phosphatidyl inositol, serine phosphoglyceride, phosphatidic acid, or mixtures thereof. Preferably, the phosphoglycerides are di-acyl esters of fatty acids having at least about 8 carbon atoms, more preferably esters of $C_8$–$C_{30}$ fatty acids, and most preferably esters of $C_{12}$–$C_{24}$ fatty acids. The remainder of the acetone-insoluble lipid material present in the substantially saturated lipid component typically comprises acetone-insoluble lipid materials such as phosphoglycolipids, phosphodiol lipids, phosphosphingolipids, glycolipids, or mixtures thereof.

The substantially saturated lipid component of the compositions herein may also contain acetone-soluble lipid material. Such acetone-soluble material can include, for example, free fatty acids, fatty acid diglycerides, and/or fatty acid triglycerides. The acetone-soluble lipid material should comprise less than about 50%, preferably from about 5% to about 50%, and more preferably from about 25% to about 45%, by weight, of the substantially saturated lipid component of the compositions herein.

The substantially saturated lipid component containing the requisite concentration of acetone-insoluble lipid materials can be derived from animal or vegetable sources (e.g., soybeans, corn, rapeseed, peanuts, sunflowers, safflowers, etc.). Preferred sources include egg yolk or soybean lecithin mixtures which are commercially available, with soybean lecithin mixtures being most preferred. The term "lecithin mixtures", as used herein, means a material which is a mixture comprising more than one phosphoglyceride component, with at least one of the phosphoglyceride components being phosphatidyl choline (i.e., pure lecithin), phosphatidyl ethanolamine, phosphatidyl inositol, serine phosphoglyceride, or phosphatidic acid. For example, commercially available soybean lecithin mixtures include Centrolex F® (trademark of Central Soya, Fort Wayne, Ind.) which comprises an approximately 95% acetone-insoluble fraction that contains at least approximately 60% phosphoglycerides. Another example is Centrol 3F-DB® (trademark of Central Soya, Fort Wayne, Ind.) which comprises an approximately 60% acetone-insoluble fraction that contains at least approximately 50% phosphoglycerides.

The acetone-insoluble lipid fraction present in soybean lecithin mixtures typically comprises: from about 20% to about 30% of phosphatidyl choline (i.e., "pure lecithin"); from about 15% to about 25% of phosphatidyl ethanolamine; from about 10% to about 20% of phosphatidyl inositol; and from about 0% to about 15% of phosphatidic acid. The acetone-soluble lipid fraction present in commercially available soybean lecithin mixtures predominantly comprises a mixture of free fatty acids, fatty acid diglycerides, and fatty acid triglycerides. A more detailed description of the composition of lecithin mixtures useful as sources of the lipid component of the present invention can be found in *Kirk-Othmer Encyclopedia of Chemical Technology,* Third Edition, Vol. 14, pages 250–269 (Grayson et al Editors; Wiley-Interscience, New York, N.Y.; 1981), the disclosure of which is incorporated herein by reference.

It is necessary that the lipid material utilized in the compositions of the present invention be selected or modified, preferably modified by hydrogenation, such that the lipid component of the composition herein is substantially saturated. The term "substantially saturated" as used herein means that the substantially saturated lipid component has an iodine value (a wellknown quantitative measure of unsaturation in lipid materials) of less than about 75, preferably less than about 65, more preferably less than about 50, and most preferably less than about 30.

For optimum textile softening performance to be realized with the compositions of the present invention, it is preferred that the substantially saturated, phosphoglyceride-containing lipid component be obtained by hydrogenating lecithin mixtures, preferably commercially available soybean lecithin mixtures. Most preferred are soybean lecithin mixtures comprising from about 5% to about 50%, preferably from about 25% to about 45%, by weight of acetone-soluble material. These particular types of soybean lecithin mixtures are preferably hydrogenated such that their iodine value is about 50 or less, more preferably about 30 or less.

Some types of hydrogenated phosphoglyceride-containing lipid mixtures are known in the art (see, for example, the *Kirk-Othmer Encyclopedia of Chemical Technology,* incorporated by reference hereinbefore). Hydrogenation processes which may be utilized to modify phosphoglyceride-containing lipid materials are also known. For example, U.S. Pat. No. 3,026,341, to Davis, Issued Mar. 20, 1962, discloses a process for hydrogenating lecithin mixtures; the disclosure of this patent is incorporated herein by reference. Hydrogenation procedures are more fully exemplified hereinafter.

It should be recognized for purposes of the present invention that the substantially saturated lipid component of the compositions herein may also be produced synthetically instead of being obtained or derived from naturally-occurring sources. Furthermore, the substantially saturated lipid component may comprise percentages of the various individual phosphoglyceride components which differ from the component concentrations typically found in commercially available lecithin mixtures. For example, the acetone-insoluble lipid material present in the substantially saturated lipid component may comprise percentages of phosphatidyl choline, phosphatidyl ethanolamine, phosphatidic acid, serine phosphoglyceride, and/or phosphatidyl inositol, which are, individually, greater than or less than those typically found in commercially available lecithin mixtures, as described hereinbefore.

In addition, it should be recognized for purposes of the present invention that the substantially saturated lipid components of the compositions herein may also be obtained by combining, for example, acetone-insoluble phosphoglycerides or phosphoglyceride-containing acetone-insoluble lipid materials with acetone-soluble lipid materials, such as by combining a hydrogenated or non-hydrogenated acetone-insoluble phosphoglyceride with hydrogenated or non-hydrogenated soybean oil (i.e., predominantly di- and triglycerides). For example, the substantially saturated, phosphoglyceride-containing lipid component might be a combination of hydrogenated Centrolex F® (described more fully hereinafter) and non-hydrogenated soybean oil.

The compositions of the present invention, which utilize substantially saturated lipid components containing the abovedescribed minimum amount of acetone-insoluble phosphoglycerides, provide surprisingly better softening performance under textile laundering conditions than do compositions in which the phosphoglycerides are not present. As noted above, for optimum textile softening performance, it is preferred that the substantially saturated, phosphoglyceride-containing lipid component be obtained by hydrogenating the lipid component, more preferably by hydrogenating lecithin mixtures, and most preferably by hydrogenating commercially available soybean lecithin mixtures.

The compositions of the present invention also provide unexpectedly superior performance relative to compositions which comprise a phosphoglyceride-containing lipid component that is not substantially saturated on the basis of color and odor profiles for textiles which have been treated during a textile laundering operation and then stored for several weeks. In particular, textiles treated with compositions which comprise a conventional fabric softening agent and a phosphoglyceride-containing lipid component which is not substantially-saturated tend to become yellow and develop a fatty odor after several weeks, whereas textiles treated with compositions of the present invention do not.

The substantially saturated lipid component of the compositions herein generally comprise from about 0.1% to about 99.9% by weight, more preferably from about 0.1% to about 30% by weight, and more preferably from about 1% to about 10% by weight of the textile treating compositions of the present invention. Furthermore, the substantially saturated lipid component of such compositions is generally present in an amount which is sufficient to provide a weight ratio of the acetone-insoluble lipid material (present in the substantially saturated lipid component) to the substantially water-insoluble cationic fabric softening agent within the range of from about 0.01:1 to about 5:1, preferably from about 0.1:1 to about 2.5:1, more preferably from about 0.1:1 to about 1.5:1, and most preferabnly about 0.5:1.

Optional components

Although textile treating compositions herein need contain only the substantially water-insoluble cationic fabric softening agent and the substantially saturated, phosphoglyceride-containing lipid component as hereinbefore described, such compositions can optionally contain a wide variety of additional ingredients. The nature and amounts of such optional components are very much dependent upon desired final form and intended means of use of the textile treating compositions.

Most frequently, the textile treating compositions herein are in liquid form suitable for addition to the rinse water during the rinse cycle of a home laundering operation. Liquid compositions of this type will generally be prepared as an aqueous dispersion of the softening agent and lipid components, and accordingly, the most commonly employed optional component of the compositions herein will be water. Water can, in fact, comprise up to about 99.9% by weight of the compositions herein. More frequently, liquid compositions of this type will comprise from about 50% to about 99.9%, preferably from about 70% to about 95%, by weight of water.

The compositions of the present invention can also contain various other compatible components such as those materials which are conventionally used in textile treating compositions. These components can include, for example, colorants, perfumes, preservatives, optical brighteners, opacifiers, pH buffers, electrolytes, viscosity modifiers, fabric conditioning agents, surfactants, stabilizers (such as polysaccharides, e.g., guar gum and polyethylene glycol), anti-shrinkage agents, anti-wrinkle agents, fabric crispening agents, spotting agents, soil release agents, germicides, fungicides, anti-oxidants (such as α-tocopherol and butylated hydroxy toluene), anti-corrosion agents, fabric softening agents which are not substantially water-insoluble cationic fabric softening agents, etc. While any or all of these optional components may be employed, the compositions of the present invention will most often include, in addition to the essential components, a dye, a perfume, and/or a preservative, with the remainder of the compositions being water.

Composition preparation

The textile treating compositions herein may be prepared by simply combining the essential and desired optional components thereof in the requisite proportions. When prepared in the form of an aqueous dispersion, the combination of essential ingredients in solid form are admixed with water, and this admixture is subjected to sufficient shear agitation to form the desired dispersion. The mean particle size of the combination of active ingredients in such dispersions, to provide optimum softening performance, will generally range from about 0.01 micron to about 10 microns, preferably within the range of from about 0.05 micron to about 1 micron. The pH of such compositions in aqueous form is not critical, and may be anywhere within the normal range for effective performance of the conventional fabric softening agent used. The natural pH of the mix components is ordinarily satisfactory. If adjustment in pH is desired for any reason, trace quantities of organic or inorganic acids or bases can be used. A preferred range is 2.0–8.0; especially preferred is 3.0–7.0.

If the textile treating compositions of the present invention are to be employed in a laundry dryer, such compositions will generally be in solid form. Frequently such compositions can be fashioned into dryer-added textile treating articles by combining such compositions with a substrate carrier. Textile treating articles of this type are described in the aforementioned U.S. Pat. Nos. 4,022,938, 3,843,395 and 3,686,025.

Textile treating method

The present invention also relates to methods for treating textiles to impart fabric softening and conditioning benefits to textiles so treated. Such a method in general is carried out by contacting textiles to be treated with a textile softening amount of a combination of the substantially water-insoluble cationic softening agent and substantially saturated, phosphoglyceride-containing lipid components of the textile treating composition hereinbefore described. Thus to carry out the textile treating methods herein, the compositions of this invention may be contacted directly with textiles to be treated or may be added to textile-containing aqueous solutions used in laundering operations.

The fabric softening compositions of the present invention are preferably used by adding such compositions to the rinse cycle during a conventional home laundering operation. For optimum softening performance, detergent carry-over from the wash cycle to the rinse cycle containing the fabric softening composition should be minimized. Generally, rinse water in such operations has a temperature of about 5° C. to about 60° C. The compositions of the present invention are used in the rinse such that the concentration of the actives (i.e., conventional cationic fabric softening agent plus lipid component) in the rinse is sufficient to impart a softening benefit to the textiles in the rinsing bath. Generally, such concentrations fall within the range of from about 10 ppm to about 1,000 ppm, preferably from about 10 ppm to about 500 ppm, most preferably from about 50 ppm to about 100 ppm, within the aqueous rinsing bath. When multiple rinses are used, the textile treating composition is preferably added to the final rinse.

As indicated, the textile treating methods of this invention may also be carried out by adding the textile treating compositions herein to an automatic laundry dryer. Such compositions may also be added to the surfactant-containing aqueous washing bath used in a home laundering operation.

The following examples illustrate the fabric softening compositions and methods of the present invention, and the benefits achieved by the utilization of such compositions and methods. These examples are illustrative of the invention herein and are not to be construed as limiting thereof.

EXAMPLE 1

Composition containing substantially saturated soybean lecithin mixture (95% acetone-insoluble lipid)

| Compound | Weight % |
|---|---|
| SBL[1] | 2.81 |
| Adogen 448E[2] | 6.42 |
| dye[3] | 0.18 |
| preservative | 0.02 |
| perfume | 0.42 |
| water | balance |

[1]soybean lecithin (Centrolex F ® from Central Soya, Fort Wayne, Indiana; approximately 95% acetone-insoluble lipid which comprises at least approximately 60% phosphoglycerides; iodine value approximately 74)
[2]trademark of Sherex Chemical Company, Inc., Dublin, Ohio; comprises approximately 85% ditallow dimethyl ammonium chloride
[3]solution containing less than about 10% dye Use of this composition during the rinse cycle while laundering textiles in a home laundering machine, at a concentration of 70 ppm, followed by drying in an automatic dryer, provides improved softening and conditioning benefits to the textiles.

EXAMPLE 2

Composition containing hydrogenated soybean lecithin mixture (95% acetone-insoluble lipid)

A. Hydrogenation of soybean lecithin mixture

Commercially available soybean lecithin containing 95% acetone-insoluble lipid material (1,500 g Centrolex F ® from Central Soya, Fort Wayne, Ind.; iodine value approximately 74; phosphoglyceride content at least approximately 60% of the acetone-insoluble lipid content) in benzene (2,300 ml) is added to approximately 4–5 grams of 10% Pd/C in 500 ml of methanol. (The 10% Pd/C in methanol is allowed to sit for 1½ hours prior to the addition of the lecithin under 200 psi of hydrogen gas.) The resulting mixture is purged 4 times with hydrogen, and then the reaction is placed under approximately 200 psi of hydrogen gas. The mixture is maintained at an average temperature of approximately 50° C. (±approximately 10° C.) under an average hydrogen gas pressure of approximately 200 psi for about 48 hours, after which time the rate of hydrogen uptake by the mixture is very slow. The reaction mixture is then filtered and the filtrate evaporated under partial vacuum to give the hydrogenated phosphoglyceride-containing lipid component (iodine value approximately 30) to be used in preparing the textile treating composition.

B. Preparation of the textile treating composition

The hydrogenated phosphoglyceride-containing lipid material from part A above (approximately 60 grams) is combined with ditallow dimethyl ammonium chloride (approximately 140 grams of Adogen 448E ®, from Sherex Chemical Company, Inc., Dublin, Ohio; approximately 85% ditallow dimethyl ammonium chloride) in a weight ratio of approximately 0.5:1 (acetone-insoluble lipid material:ditallow dimethyl ammonium chloride). This solid combination is heated to the point of melting (approximately 150° F.) and then stirred for about 5 minutes to mix the components. At this time approximately 196 grams of the hot melt is poured into approximately 1,800 grams of distilled water (pH approximately 5) containing about 0.4 grams Kathon® (preservative made by Rohm and Haas, Philadelphia, Pa.) at approximately 150° F. This mixture is then subjected to high speed mechanical shearing for approximately 10 minutes in a mixer (Tekmar SD-45, manufactured by Tekmar, Cincinnati, Ohio, and using a G-456 generator, manufactured by Tekmar, Cincinnati, Ohio set at speed setting of 60). This mixture is then cooled to approximately 100° F. and approximately 9 grams of perfume is mixed in with slow speed stirring. The viscosity of the final product is approximately 24 cps and the mean particle size of the solid active combination is approximately 0.2 microns.

Use of this composition during the rinse cycle while laundering textiles in a home laundering machine, at a concentration of 70 ppm, followed by drying the textiles in an automatic dryer, provides improved softening and conditioning benefits to the textiles.

EXAMPLE 3

Composition containing hydrogenated egg yolk L-α-phosphatidyl choline

A. Hydrogenation of egg yolk L-α-phosphatidyl choline 100 grams of egg yolk L-α-phosphatidyl choline (i.e., pure egg yolk lecithin; Sigma Chemical Co., St. Louis, Mo.) is added to approximately 0.5–1 grams Pd/C in approximately 140 ml methanol. The Pd/C in methanol has been previously allowed to sit for 100 minutes under 180 psi of hydrogen gas at room temperature, exhausted of hydrogen gas and then flushed with nitrogen gas. This mixture is then flushed four times with hydrogen gas, and the reaction mixture then placed under approximately 100 psi of hydrogen gas. The mixture is maintained at a temperature between about 50°–80° C. under an average hydrogen gas pressure of approximately 150 psi for about 26 hours, after which time the rate of hydrogen gas uptake by the mixture is very slow. The reaction mixture is then filtered and the filtrate evaporated under partial vacuum to give the hydrogenated egg yolk phosphatidyl choline to be used in the textile treating composition.

B. Textile treating composition containing hydrogenated egg yolk phosphatidyl choline Utilizing a preparation procedure essentially the same as described in Example 2(B) hereinbefore, the following textile treating composition is prepared.

| Component | Weight % |
|---|---|
| EYLH[1] | 2.94% |
| DTDMAC[2] | 2.31% |
| Preservative | 0.02% |
| Perfume | 0.45% |
| Water | balance |

[1]hydrogenated egg yolk lecithin prepared as in Example 3(A).
[2]ditallow dimethyl ammonium chloride Use of this composition during the rinse cycle while laundering textiles in a laundering machine, at a concentration of 230 ppm, followed by line drying the textile, provides improved softening and conditioning benefits to the textiles.

EXAMPLE 4

Composition containing hydrogenated soybean lecithin mixture (60% acetone-insoluble lipid).

Commercially available soybean lecithin containing approximately 60% acetone-insoluble lipid material (Centrol 3F-DB® from Central Soya, Fort Wayne, Ind.; iodine value approximately 97; phosphoglyceride content at least about 50% of acetone-insoluble lipid content) is hydrogenated using essentially the same procedure as in Example 2(A) (except that methanol is used as the solvent in place of benzene) to give a hydrogenated phosphoglyceride-containing lipid material (iodine value approximately 68). Preparation of a textile treating composition utilizing essentially the same procedure as in Example 2(B) hereinbefore gives the following composition.

| Component | Weight % |
|---|---|
| SBLH[1] | 5.34 |
| Adogen 448E ®[2] | 6.42 |
| dye[3] | 0.18 |
| preservative | 0.02 |
| perfume | 0.42 |
| water | balance |

[1]hydrogenated Centrol 3F-DB ®
[2]trademark of Sherex Chemical Company, Inc., Dublin, Ohio; comprises approximately 85% ditallow dimethyl ammonium chloride
[3]solution containing less than about 10% dye Use of this composition during the rinse cycle while laundering textiles in a home laundering machine, at a concentration of 430 ppm, followed by line drying, provides improved softening and conditioning benefits to the textiles.

EXAMPLE 5

Compositions containing hydrogenated soybean lecithin mixture (60% acetone-insoluble lipid)

| | Weight % | |
|---|---|---|
| Component | Composition A | Composition B |
| SBLH[1] | 5.78 | 5.78 |
| Adogen 448E ®[2] | 4.63 | — |
| di-hardtallow imidazoline[3] | 1.93 | 6.3 |
| dye solution[4] | 0.18 | 0.18 |
| preservative | 0.02 | 0.02 |
| perfume | 0.42 | 0.42 |
| water | balance[5] | balance[6] |

[1]hydrogenated Centrol 3F-DB ® described in Example 4
[2]trademark of Sherex Chemical Company, Inc., Dublin, Ohio; comprises approximately 85% ditallow dimethyl ammonium chloride
[3]approximately 90% 1-hardtallow amido ethyl-2-hardtallow imidazoline obtained from Sherex Chemical Company, Inc., Dublin, Ohio (comprises an equilibrium mixture of the cyclic form as 1-hardtallow amido ethyl-2-hardtallow imidazoline, and the straight chain form as $RCONHCH_2CH_2NHCH_2CH_2NHCOR$, wherein the R's are hardtallow.)
[4]solution containing less than about 10% dye
[5]pH of final product approximately 2 by acidifying water with HCl
[6]pH of final product approximately 4 by acidifying water with HCl Use of either of these compositions during the rinse cycle while laundering textiles in a home laundering machine, at a concentration of 430 ppm, followed by line drying, provides improved softening and conditioning benefits to the textiles.

EXAMPLE 6

Composition containing hydrogenated soybean lecithin mixture (60% acetone-insoluble lipid)

Commercially available fluid soybean lecithin containing approximately 60% acetone-insoluble lipid material (fluid soybean lecithin from Victory Soya, Toronto, Canada; iodine value approximately 93; phosphoglyceride content at least about 50% of acetone-insoluble lipid content) is hydrogenated using essentially the same procedure as in Example 2(A) (except that methanol is used as the solvent in place of benzene) to give a hydrogenated phosphoglyceride-containing lipid material (iodine value approximately 26). Preparation of a textile treating composition utilizing essentially the same procedure as in Example 2(B) (except that a Brookfield Counter-Rotating Mixer, Model L891, manufactured by Brookfield Engineering Lab, Stoughton, Mass. is utilized) gives the following composition.

| Component | Weight % |
|---|---|
| SBLH[1] | 5.28 |
| Adogen 448E ®[2] | 6.75 |
| dye[3] | 0.29 |
| preservative | 0.02 |
| perfume | 0.46 |
| water | balance |

[1]hydrogenated Victory fluid soybean lecithin
[2]trademark of Sherex Chemical Company, Inc., Dublin, Ohio; comprises approximately 85% ditallow dimethyl ammonium chloride
[3]solution containing less than about 10% dye Use of this composition during the rinse cycle while laundering textiles in a home laundering machine, at a concentration of 70 ppm, followed by drying the textiles in an automatic dryer, provides improves softening and conditioning benefits to the textiles.

EXAMPLE 7

Composition containing hydrogenated soybean lecithin mixture (60% acetone-insoluble lipid)

Commercially available soybean lecithin containing approximately 60% acetone-insoluble lipid material (Centrol 3F-DB ® from Central Soya, Fort Wayne, Ind.; iodine value approximately 97; phosphoglyceride content at least about 50% of acetone-insoluble lipid content) is hydrogenated using essentially the same procedure as in Example 2(A) (except that methanol is used as the solvent in place of benzene) to give a hydrogenated phosphoglyceride-containing lipid material (iodine value approximately 19). Preparation of a textile treating composition utilizing essentially the same procedure as in Example 2(B) hereinbefore gives the following composition.

| Component | Weight % |
|---|---|
| SBLH[1] | 5.56 |
| Adogen 448E[2] | 6.69 |
| dye[3] | 0.18 |
| preservative | 0.02 |
| perfume | 0.42 |
| water | balance |

[1]hydrogenated Centrol 3F-DB ®
[2]trademark of Sherex Chemical Company, Inc., Dublin, Ohio; comprises approximately 85% ditallow dimethyl ammonium chloride
[3]solution containing less than about 10% dye Use of this composition during the rinse cycle while laundering textiles in a home laundering machine, at a concentration of 70 ppm, followed by drying the textiles in an automatic dryer, provide improved softening and conditioning benefits to the textiles.

What is claimed is:

1. A textile treating composition suitable for imparting textile softening benefits to textiles treated therewith, which composition comprises:

(a) from about 0.1% to about 99.9% by weight of a substantially water-insoluble cationic fabric softening agent; and (b) from about 0.1% to about 99.9% by weight of a substantially saturated, phosphoglyceride-containing lipid component comprising at least about 50% by weight of an acetone-insoluble lipid material, with said acetone-insoluble lipid material comprising at least about 50% by weight of one or more acetone-insoluble phosphoglycerides;

the weight ratio of said acetone-insoluble lipid material to said fabric softening agent being in the range of from about 0.01:1 to about 5:1.

2. A textile treating composition according to claim 1 wherein the composition comprises:

(a) from about 0.1% to about 30% by weight of the substantially water-insoluble cationic fabric softening agent; and (b) from about 0.1% to about 30% by weight of the substantially saturated, phosphoglyceride-containing lipid component;

and further wherein the ratio of the acetone-insoluble lipid material to the cationic fabric softening agent is in the range of from about 0.1:1 to about 2.5:1.

3. A textile treating composition according to claim 2 wherein the cationic fabric softening agent is selected from tetraalkyl quaternary ammonium salts, alkyl imidazolinium salts, alkyl pyrimidinium salts, or mixtures thereof; and wherein the acetone-insoluble phosphoglyceride component is selected from phosphatidyl choline, phosphatidyl ethanolamine, phosphatidyl inositol, serine phosphoglyceride, phosphatidic acid, or mixtures thereof.

4. A textile treating composition according to claim 3 wherein the substantially saturated, phosphoglyceride-containing lipid component is derived from soybean or egg yolk.

5. A textile treating composition according to claim 4 wherein the substantially saturated, phosphoglyceride-containing lipid component is a hydrogenated soybean lecithin mixture.

6. A textile treating composition according to claim 3 wherein the substantially saturated, phosphoglyceride-containing lipid component has an iodine value of less than about 50.

7. A textile treating composition according to claim 6 wherein the substantially saturated, phosphoglyceride-containing lipid component comprises from about 5% by weight of acetone-soluble lipid material.

8. A textile treating composition according to claim 7 wherein the substantially saturated, phosphoglyceride-containing lipid component is a hydrogenated soybean lecithin mixture.

9. A liquid textile treating composition suitable for addition to a textile-containing aqueous rinsing bath in order to impart softening benefits to textiles therein, said composition comprising:

(a) from about 0.1% to about 30% by weight of a cationic fabric softening agent selected from substantially water-insoluble tetraalkyl quaternary ammonium salts, substantially water-insoluble alkyl imidazolinium salts, substantially water-insoluble alkyl pyrimidinium salts, and mixtures thereof;

(b) from about 0.1% to about 30% by weight of a substantially saturated, phosphoglyceride-containing lipid component comprising at least about 50% by weight of an acetone-insoluble lipid material, with said acetone-insoluble lipid material comprising at least about 50% by weight of a phosphoglyceride selected from phosphatidyl choline, phosphatidyl ethanolamine, phosphatidyl inositol, serine phosphoglyceride, phosphatidic acid, or mixtures thereof; and (c) from about 50% to about 99.9% by weight of water;

the weight ratio of the acetone-insoluble lipid material to the fabric softening agent being within the range of from about 0.1:1 to about 2.5:1.

10. A liquid textile treating composition according to claim 9 wherein the composition is in the form of an aqueous dispersion of the softening agent/lipid material combination, and wherein the mean particle size of the softening agent/lipid component combination ranges from about 0.01 microns to about 10 microns.

11. A liquid textile treating composition according to claim 10 wherein the substantially saturated, phosphoglyceride-containing lipid component is derived from soybean or egg yolk.

12. A liquid textile treating composition according to claim 11 wherein the substantially saturated, phosphoglyceride-containing lipid component is a hydrogenated soybean lecithin mixture.

13. A liquid textile treating composition according to claim 12 wherein the substantially saturated, phosphoglyceride-containing lipid component has an iodine value of 50 or less, and wherein said component comprises from about 5% to about 50% by weight of acetone-soluble lipid material.

14. A method for treating textiles to impart fabric softening and conditioning benefits to textiles so treated, which method comprises contacting said textiles with a textile softening amount of a combination of:

(a) a substantially water-insoluble cationic fabric softening agent; and (b) a substantially saturated, phosphoglyceride-containing lipid component comprising at least about 50% by weight of an acetone-insoluble lipid material, with said acetone-insoluble lipid material comprising at least about 50% by weight of one or more acetone-insoluble phosphoglycerides;

the weight ratio of said acetone-insoluble lipid material to said cationic fabric softening agent being in the range of from about 0.01:1 to about 5:1.

15. A method for treating textiles according to claim 14 wherein:

the substantially water-insoluble cationic fabric softening agent is selected from substantially water-insoluble tetraalkyl quaternary ammonium salts, substantially water-insoluble alkyl imidazolinium salts, substantially water-insoluble alkyl pyrimidinium salts, and mixtures thereof;

the acetone-insoluble phosphoglyceride component is selected from phosphatidyl choline, phosphatidyl ethanolamine, phosphatidyl inositol, serine phosphoglyceride, phosphatidic acid, or mixtures thereof; and the weight ratio of said acetone-insoluble lipid material to said cationic fabric softening agent is in the range of from about 0.1:1 to about 2.5:1.

16. A method for treating textiles according to claim 15 wherein the substantially saturated, phosphoglyceride-containing lipid component is derived from soybean or egg yolk.

17. A method for treating textiles according to claim 16 wherein the substantially saturated, phosphoglyceride-containing lipid component is a hydrogenated soybean lecithin mixture.

18. A method for treating textiles according to claim 17 wherein the substantially saturated, phosphoglyceride-containing lipid component has an iodine value of 50 or less, and comprises from about 5% to about 50% by weight of acetone-soluble lipid material.

19. A method for treating textiles according to claim 14 wherein the textiles are contacted with the softening agent/lipid component combination in an aqueous bath containing from about 10 ppm to about 1000 ppm of said combination.

20. A method for treating textiles according to claim 14 wherein the textiles are contacted with a textile softening amount of the softening agent/lipid component combination in a dryer.

* * * * *